US005695101A

United States Patent [19]

Frietze

[11] Patent Number: 5,695,101

[45] Date of Patent: Dec. 9, 1997

[54] SPORTS EQUIPMENT CARRYING APPARATUS

[76] Inventor: Norberto Cipriano Frietze, 1165 Magnolia, Ave., Carlsbad, Calif. 92008

[21] Appl. No.: 685,631

[22] Filed: Jul. 24, 1996

[51] Int. Cl.[6] ..... A45F 3/14

[52] U.S. Cl. ..... 224/250; 224/257; 224/579

[58] Field of Search ..... 224/257, 258, 224/250, 579, 580

[56] References Cited

U.S. PATENT DOCUMENTS

| | | | |
|---|---|---|---|
| 3,841,542 | 10/1974 | Hogensen | 224/586 |
| 4,002,277 | 1/1977 | Westerholm . | |
| 4,483,380 | 11/1984 | Beran | 150/52 |
| 4,724,989 | 2/1988 | Silberberg | 224/202 |
| 4,911,347 | 3/1990 | Wilhite | 224/257 |
| 4,972,981 | 11/1990 | Gex | 224/250 X |
| 5,261,554 | 11/1993 | Forbes | 224/257 X |
| 5,335,835 | 8/1994 | Hogan | 224/257 |
| 5,370,286 | 12/1994 | Newman | 224/257 X |
| 5,437,401 | 8/1995 | Seltzer | 224/258 X |
| 5,603,545 | 2/1997 | Benson et al. | 224/257 X |

*Primary Examiner*—Renee S. Luebke

[57] ABSTRACT

A sports equipment carrying apparatus comprising a plurality of adjustable straps fashioned into loops for encircling a plurality of pieces of sports equipment such as body-boards and folding chairs. In the preferred embodiment, two adjustable loops encircle the equipment, and a third loop is used to connect and suspend the two enclosing loops from the user's shoulder. Each adjustable strap may be of a singular construction, or may include at least one removable "link" strap for lengthening or shortening the adjustable loops. Each of the plurality of adjustable straps and the removable link straps may further comprise means for attaching various sporting accessories such as swim fins, a water bottle, or an accessory bag. The encircled sports equipment, such as the body-board and the folding chair, provide rigidity of the carrying apparatus when in use. Additionally, the plurality of adjustable straps, having very little size and weight of its own, is easily stored when not in use. Furthermore, the present invention is extremely adaptable to various sizes and shapes of sporting equipment even though it is very small and light in construction.

16 Claims, 4 Drawing Sheets

SPORTS EQUIPMENT CARRYING APPARATUS

BACKGROUND OF THE INVENTION

I. Field of the Invention

The present invention relates generally to carrying devices for recreational sporting equipment. More particularly, the present invention is directed to a novel and improved apparatus for carrying recreational sporting equipment and associated accessories.

II. Description of the Related Art

Recreational sports in general have gained much popularity recently as people have become more health conscious. For example, the recreational watersport of body-boarding has increased in popularity in recent years and has become an international sport. Several sanctioned events are now held worldwide which attribute to its popularity. A similar increase in the popularity of other watersports such as surfing and water-skiing has been observed.

The watersport enthusiast typically uses several pieces of equipment that aid enjoyment of the sport while in the water. For example, a body-boarder commonly uses a body board, a pair of swim fins, and a wetsuit. Additionally, the recreational watersport enthusiast who has planned a long day at the beach, lake, or wave-pool will want to use various accessory equipment to make himself more comfortable out of the water. This accessory equipment may include, for example, a folding beach chair, a towel, a water bottle, and sunscreen.

Depending on the location and remoteness of the water, the recreational watersport enthusiast often must carry his equipment over a relatively long distance on foot. Given the size, shape, weight, volume and sheer number of pieces of equipment that the recreational watersport enthusiast must carry to and from the water, he is often forced to limit the amount of equipment he may carry in one trip. Clearly, the lack of portability of the equipment detracts from the enjoyment of the activity, and from the time available for actual recreation.

To overcome these problems of portability, some prior art solutions use large shoulder-borne carrying cases, such as surfboard or body-board bags in which the recreational enthusiast may place his equipment. The prior art carrier disclosed in U.S. Pat. No. 4,483,380, issued Nov. 20, 1984, entitled "FOLDABLE PROTECTIVE COVER AND CARRIER FOR SPORTS EQUIPMENT" is an example of such a shoulder-borne carrying case. However, due to the large amount of fabric or nylon required for their construction, these prior art carriers are very expensive.

Other prior art solutions use stiff bars or rods to suspend the watersport equipment. For example, the prior art carrier disclosed in U.S. Pat. No. 4,724,989, issued Feb. 16, 1988, entitled "SAILBOARD CARRYING APPARATUS" employs a rigid "carrier bar" to suspend the equipment. However, this carrier bar also adds to the size, weight, cost, and storage space of the carrier. Additionally, neither of the above prior art carriers are designed to be able to carry many different pieces of equipment of different sizes and shapes. In order to do so, the "bag" would need to be as large as the largest piece of equipment that the recreational sporting enthusiast wished to carry. Thus, they are restricted to carrying only the primary piece of equipment, such as the surfboard, body-board, or sailboard, and are not adaptable to carry all of the various accessories such as those named above.

Still other prior art sporting equipment carriers, such as the snow-ski carriers illustrated in U.S. Pat. No. 3,841,542, issued Oct. 15, 1974, entitled "SKI CARRIER STRAP DEVICE," and U.S. Pat. No. 4,002,277, issued Jan. 11, 1977, entitled "SKI TOTE DEVICE," use shoulder harnesses to carry the equipment. Although these devices are smaller and easier to store, they still only provide means for carrying the skis themselves and not any associated accessories. An additional problem of each of the prior art carriers noted above is that they are not adjustable over a wide range of equipment sizes, shapes and combinations.

What is needed is a low-cost, easy to manufacture sporting equipment carrying apparatus which is easy to use, easy to store, and is adaptable to carrying multiple pieces of sporting equipment, having varying shapes and sizes, all in combination at the same time.

SUMMARY OF THE INVENTION

The present invention is a novel and improved sports equipment carrying apparatus. The apparatus comprises a plurality of adjustable straps fashioned into loops for encircling a plurality of pieces of sports equipment such as body-boards and folding chairs. In the preferred embodiment, two adjustable loops encircle the equipment, and a third loop is used to connect and suspend the two enclosing loops from the user's shoulder. In other embodiments, more loops may be used as necessary to accommodate the equipment.

Each adjustable strap may be of a singular construction, such as one long strap, or may include at least one removable "link" strap for lengthening or shortening the adjustable loops. Each of the plurality of adjustable straps and the removable link straps may further comprise means for attaching various sporting accessories such as swim fins, a water bottle, or an accessory pouch.

The present invention is particularly suited for simultaneously carrying a water-board, such as a body-board, surfboard, skim-board, waterski, or wake-board, and a folding chair such as a beach chair. The encircled sports equipment, such as the body-board and the folding chair, provide rigidity of the carrying apparatus when in use, thus avoiding the prior art need for a "carrier bar" or the like. Additionally, the plurality of adjustable straps, having very little size and weight of its own, is easily stored when not in use. Furthermore, the present invention is extremely adaptable to various sizes and shapes of sporting equipment even though it is very small and light in construction.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

The preferred embodiment of the present invention will now be described with reference to an exemplary set of sporting equipment suitable for body-boarding. However, it should be noted that the teachings of the present invention are equally applicable to other sporting equipment such surfboards and water-skis. Furthermore, the teachings of the present invention are not intended to be limited to watersports, but may include land-based sports as well such as snow-skiing or baseball. The present invention is adaptable, without departing from the spirit of the invention, to carry almost all types of recreational equipment.

Figure 1:
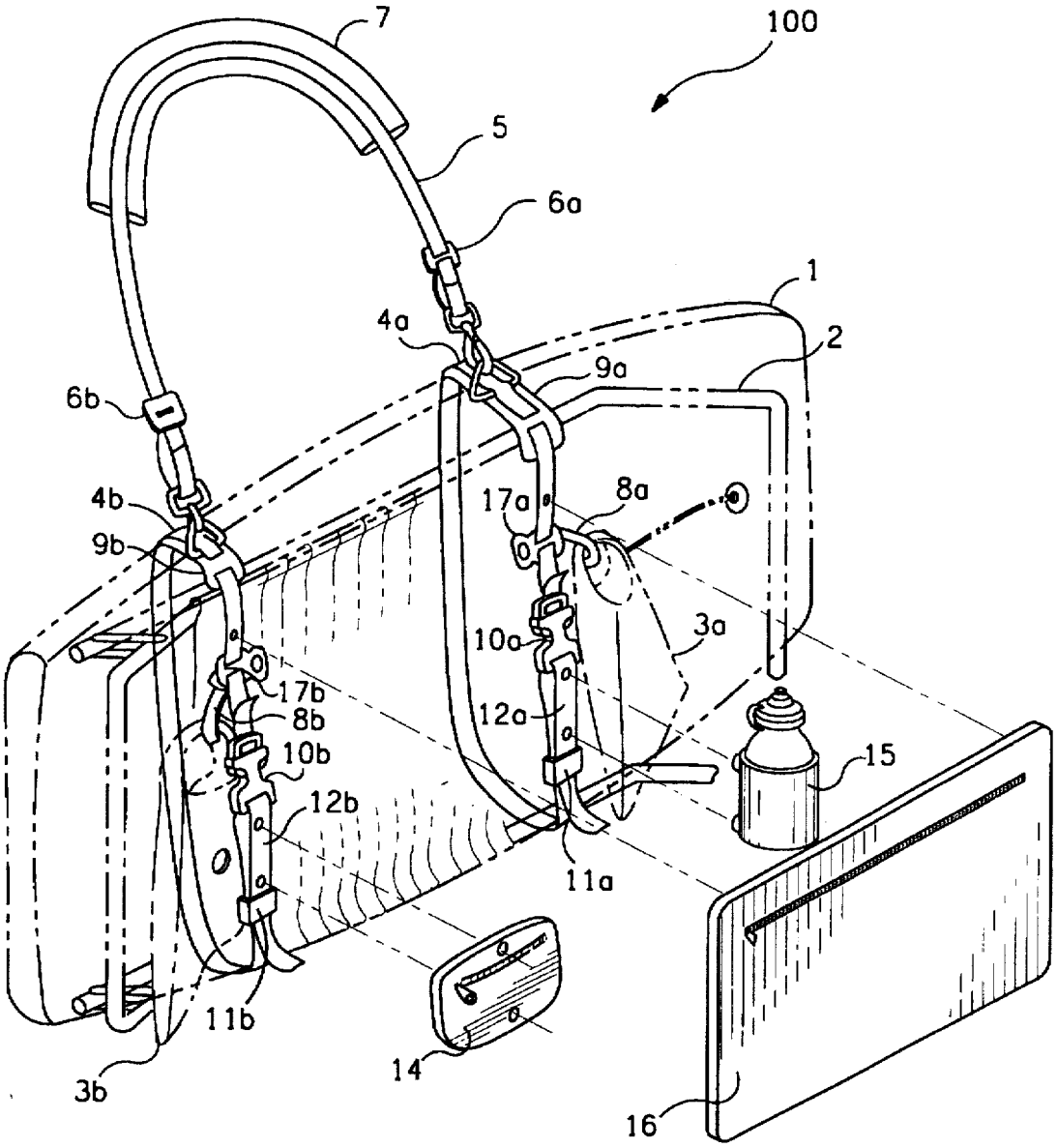
FIG. 1 is an illustration of an exemplary embodiment of the present invention employed to encircle a body board and a beach chair simultaneously, with the body board and beach chair shown in ghost view.
Figure 6:
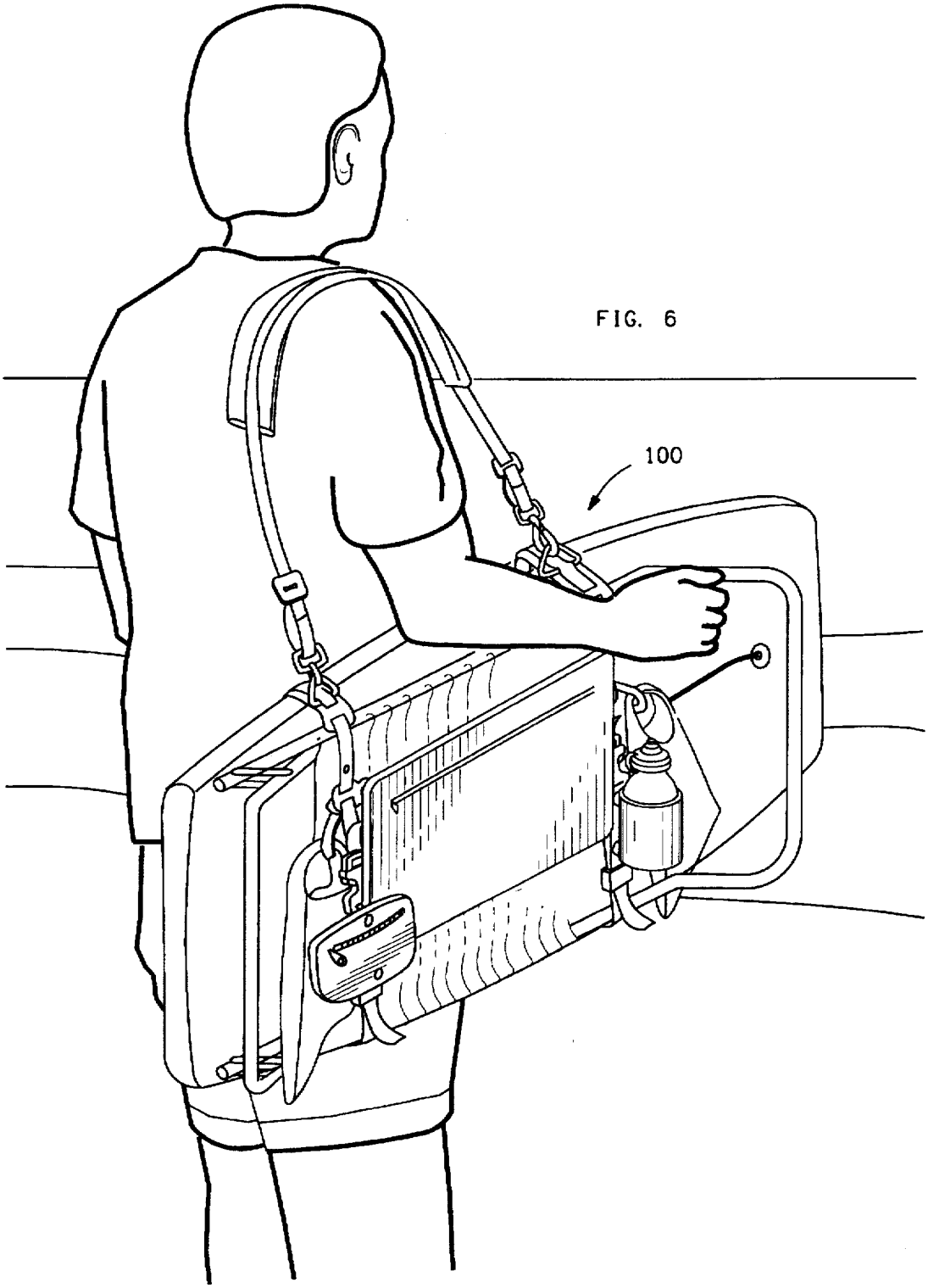
FIG. 6 is an illustration of a user employing the present invention.

Referring now to FIG. 1, an illustration of an exemplary embodiment of the carrier 100 of the present invention employed to carry a body board 1 and a folding beach chair 2 simultaneously, with the body board 1 and folding beach chair 2 illustrated in ghost view, is shown. Adjustable encircling loops 4a and 4b are illustrated encircling both body board 1 and folding beach chair 2. A shoulder harness loop 5 connects adjustable encircling loop 4a to adjustable encircling loop 4b. When in use, adjustable encircling loops 4a and 4b are fastened, substantially in parallel, around the body board 1 and the folding beach chair 2 in such a manner as to evenly distribute the weight and volume of body board 1 and folding beach chair 2 when carried by shoulder harness loop 5. For example, the carrier 100 may be adjusted by sliding buckles 6a and 6b to be carried over one shoulder (as shown in FIG. 6), or it may be carried abreast, or by hand, depending on the preferences of the user.

In the exemplary embodiment of FIG. 1, adjustable encircling loops 4a and 4b and shoulder harness loop 5 are made of a webbed nylon strap construction. However, in other embodiments, they may be made of cloth, elastic rubber, leather or the like as is known in the art. Additionally, in the exemplary embodiment of FIG. 1, shoulder harness loop 5 includes a shoulder pad 7 which may be made of cloth, rubber, leather, or nylon-covered foam rubber as is known in the art. Body-board 1 and folding beach chair 2 are held securely between adjustable encircling loops 4a and 4b by steadying pads 9a and 9b which may be rubberized to prevent slipping of the wet body-board 1 or sand-covered folding beach chair 2.

Figure 3:
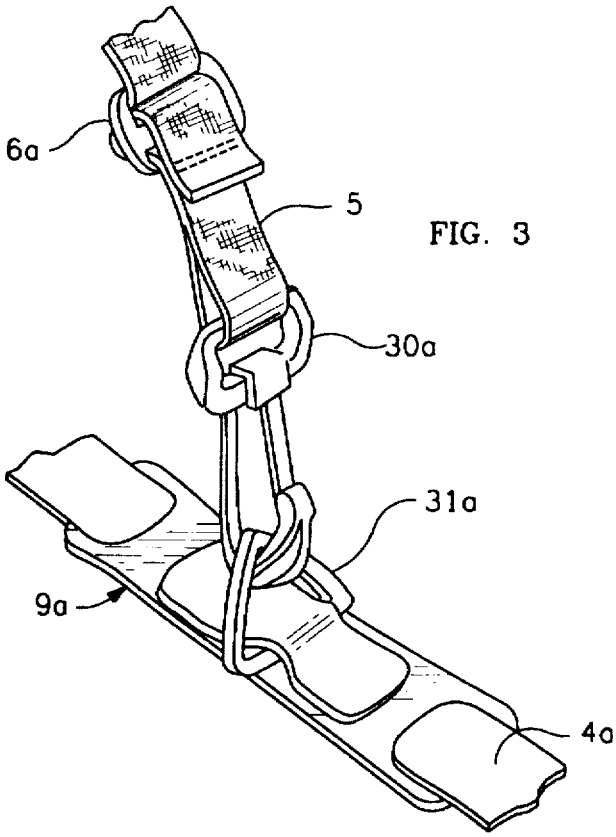
FIG. 3 is a close-up view of the connection of the shoulder harness loop of the present invention to one of the plurality of equipment encircling loops.

Referring now to FIG. 3, in the preferred embodiment, steadying pads 9a and 9b provide a convenient anchor point for the connection of shoulder harness loop 5. In FIG. 3, adjustable encircling loop 4a is threaded through steadying pad 9a, providing an attachment point for triangular eye 31a. Snap hook 30a snaps onto triangular eye 31a to connect shoulder harness loop 5 adjustable encircling loop 4a. In the preferred embodiment triangular eye 31a and snap hook 30a are constructed from hard plastic in order to provide strength while resisting corrosion. An identical construction may be used to connect shoulder harness loop 5 to adjustable encircling loop 4b. However, it should be noted that other types of connectors made from other materials may be used to accomplish the same function of triangular eye 31a and snap hook 30a.

Figure 2B:
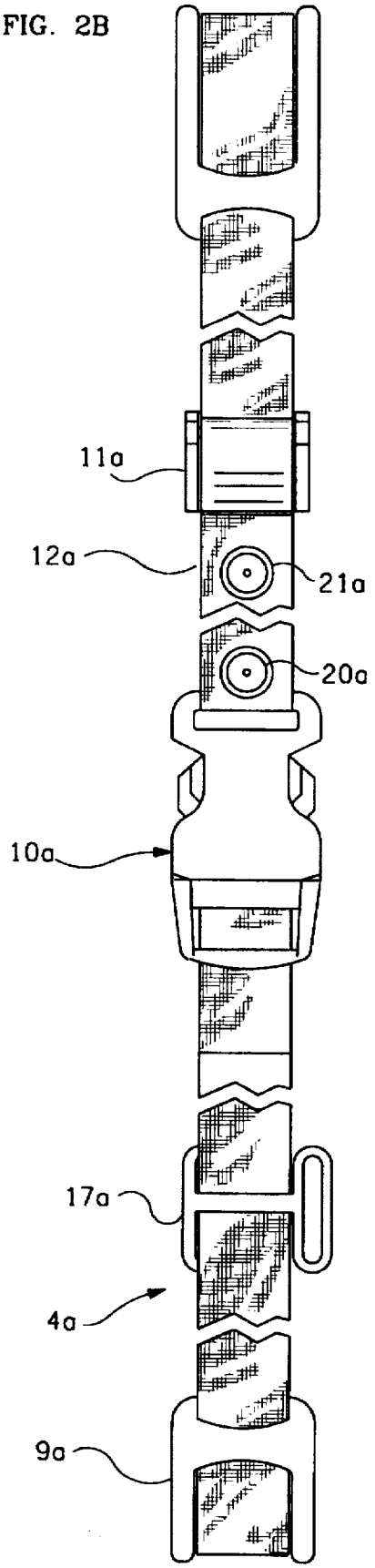
FIG. 2B is a front view of the exemplary adjustable loop of FIG. 2A.
Figure 2A:
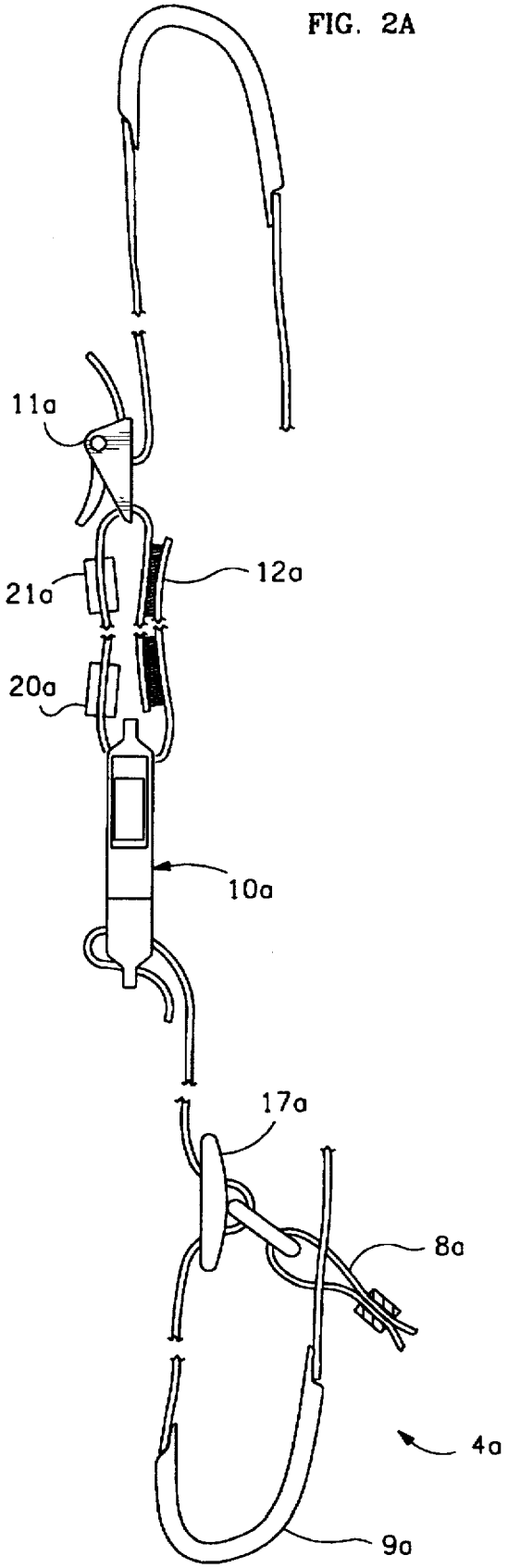
FIG. 2A is a side view of an exemplary adjustable loop of the present invention.

Again referring to FIG. 1, adjustable encircling loops 4a and 4b are each finely adjustable in circumference by snap lock connectors 10a and 10b, respectively. In the preferred embodiment, snap lock connectors 10a and 10b are hard plastic connectors having a single strap loopback for adjustably securing a free end of adjustable encircling loops 4a and 4b, respectively. Snap-lock connectors are well known in the art. Alternate embodiments use other types of connectors. When a large circumference is required to encircle the body-board 1 and folding beach chair 2, snap lock connectors and 10b may be adjusted to let out more slack in adjustable encircling loops 4a and 4b, respectively. In contrast, when a smaller circumference is required, such as when carrying a smaller body-board 1 or a smaller folding beach chair 2, the snap lock connectors 10a and 10b may be adjusted by several inches to take in the excess slack of adjustable encircling loops 4a and 4b, respectively. FIGS. 2A and 2B show a side view and a front view, respectively, of snap lock connector 10a in the locked position. An identical construction may be used for snap lock connector 10b.

Figure 5:
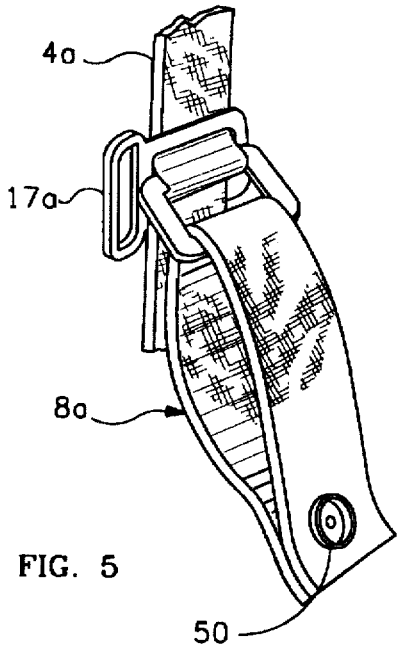
FIG. 5 is a close-up view of one of the accessory loops of the present invention.

In the preferred embodiment of FIG. 1, exemplary swim fins 3a and (shown in ghost view) are connected to adjustable encircling loops 4a and 4b respectively, by means of half-breast connectors 17a and 17b in combination with associated accessory loops 8a and 8b. Referring now to FIG. 5, half-breast connector 17a is slidably mounted on adjustable encircling loop 4a. Accessory loop 8a is looped through half-breast connector 17a to form a hanging loop for attachment of various accessories. In the embodiment of FIG. 5, accessory loop 8a is constructed of a single webbed nylon strap which may be closed by means of snap 50. Again it should be noted that other constructions may accomplish the same function without departing from the spirit and intent of the present invention.

Referring again to FIG. 1, the length of adjustable encircling loops 4a and 4b may be coarsely adjusted by means of at least one removable link loop 12a and 12b, respectively, as shown in FIGS. 2A and 2B. In FIGS. 2A and 2B, removable link loop 12a is shown to have the female portion of snap lock connector 10a attached to a top end, and a cam buckle connector 11a attached to a bottom end. Other embodiments use other types of connectors. The user of the carrier 100 may add or remove as many removable link loops 12a as is necessary to obtain the proper circumference in coarse steps for adjustable encircling loops 4a and 4b. Removable link loop 12a may also comprise snaps 20a and 21a for further attachment of sporting accessories. For example, in the embodiment of FIG. 1, beverage holder 15 may be snapped onto adjustable encircling loop 4a, while a small pouch 14 may be snapped onto adjustable encircling loop 4b. Furthermore, a large pouch 16 may, in turn, be snapped onto both adjustable encircling loops 4a and 4b and further steadied by a fastening strap (not shown) attached to both half-breast connectors 17a and 17b. Such a large pouch 16 is ideal for carrying larger items such as wetsuits and towels. Clearly, many different types of sporting accessories may be attached to the adjustable encircling loops 4a and 4b.

Figure 4:
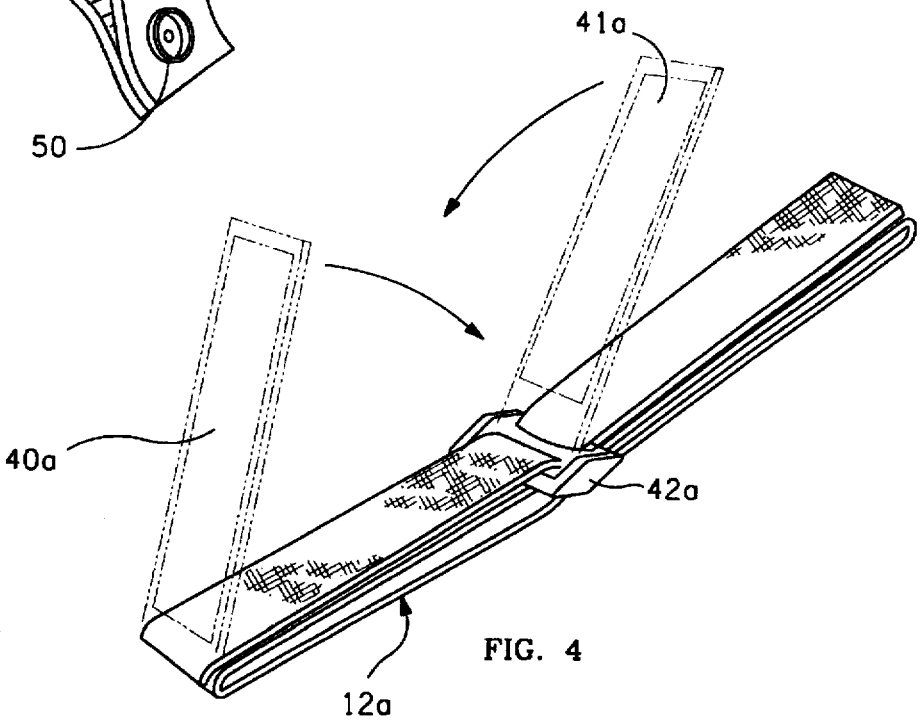
FIG. 4 is a close-up view of one of the removable link loops of the present invention in a closed position with an open position shown in ghost view.

Referring now to FIG. 4, the preferred embodiment of removable link loop 12a is shown. Removable link loop 12a is preferably of a singular construction of webbed nylon strap, having opposing Velcro patches 40a and 41a sewn at respective ends. Other embodiments use other materials and other connection means. When the two ends of removable link loop 12a are folded over each other as shown in FIG. 4, opposing Velcro patches 40a and 41a interlock, forming a single removable link loop 12a. Many such removable link loops 12*a* may be linked together by means of intermediate loop connectors 42*a*. Intermediate loop connector 42*a* may be a ring-type connector as is known in the art. A similar construction may be used for removable link loop 12*b*.

As previously noted, fine adjustments in the length of adjustable encircling loops 4*a* and 4*b* may be made at snap lock connectors 10*a* and 10*b*, respectively. Additionally, coarse adjustments in the length of adjustable encircling loops 4*a* and 4*b* may be made by adding or removing removable link loops 12*a* and 12*b*, respectively. In this manner, the present invention provides an exceptionally adaptable carrier 100 which is adjustable to hold many different sizes, shapes and combinations of sporting equipment simultaneously, while still being easy to adjust.

Referring now to FIG. 6, an illustration of a user employing the carrier 100 present invention is shown. Since the carrier 100 is carried over the user's shoulder, it is highly portable, with the sporting equipment itself providing rigidity during transport. However, since it is of light and simple construction, it is easily stored, taking up very little space. Thus, the present invention is a low-cost, easy to manufacture sporting equipment carrying apparatus which is easy to use, easy to store, and is adaptable to carrying multiple pieces of sporting equipment, having varying shapes and sizes, all at the same time.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

I claim:

1. An equipment carrier for carrying at least one piece of sporting equipment, said equipment carrier comprising:

a plurality of adjustable carrying straps for encircling said at least one piece of sporting equipment;

a suspending strap, detachably connected at a first end to a first of said plurality of adjustable carrying straps and detachably connected at a second end to a second of said plurality of adjustable carrying straps, said suspending strap for suspending said encircled at least one piece of sporting equipment; and a plurality of steadying pads, each steadying pad being respectively attached to a different one of said plurality of adjustable carrying straps, said plurality of steadying pads for securing said encircled at least one piece of sporting equipment within said plurality of adjustable carrying straps.

2. The equipment carrier of claim 1 further comprising means for attaching at least one sporting accessory to one of said plurality of adjustable carrying straps.

3. The equipment carrier of claim 1 wherein said suspending strap is respectively detachably connected to said first and second adjustable carrying straps by first and second connectors, and wherein first and second steadying pads of said plurality of steadying pads are further for limiting travel of said first and second connectors along said first and second carrying straps.

4. The equipment carrier of claim 1 further comprising a plurality of removable link straps, each removable link strap for detachably connecting to at least one of said plurality of adjustable carrying straps, thereby altering a respective length of said at least one of said plurality of adjustable carrying straps.

5. An equipment carrier for simultaneously carrying a plurality of recreational equipment items, said equipment carrier comprising:

first and second adjustable loops for surrounding said plurality of recreational equipment items, said first and second adjustable loops being substantially parallel when surrounding said plurality of recreational equipment items, said first and second adjustable loops having first and second loop adjustment means for altering a respective circumference of said first and second adjustable loops;

a shoulder harness, detachably connected at a first end to said first adjustable loop and detachably connected at a second end to said second adjustable loop, said shoulder harness for suspending said surrounded plurality of recreational equipment items; and first and second steadying pads respectively attached to said first and second adjustable loops, said first and second steadying pads for securing said surrounded plurality of recreational equipment items within said first and second adjustable loops.

6. The equipment carrier of claim 5 further comprising means for attaching a first recreational accessory to at least one of said first and second adjustable loops.

7. The equipment carrier of claim 5 wherein said shoulder harness is respectively detachably connected to said first and second adjustable loops by first and second harness connectors, said first and second steadying pads further for limiting travel of said first and second harness connectors along said first and second loops.

8. The equipment carrier of claim 7 wherein said first and second harness connectors are hook and eye connectors.

9. The equipment carrier of claim 7 wherein said first and second loop adjustment means are snap lock connectors.

10. The equipment carrier of claim 7 wherein said first and second link connectors are cam buckles.

11. The equipment carrier of claim 5 further comprising a plurality of removable link loops, each removable link loop for respectively detachably connecting to said first and second adjustable loops by first and second link connectors, thereby further altering said respective circumference of said first and second adjustable loops.

12. The equipment carrier of claim 11 wherein each of said plurality of removable link loops further comprises means for attaching a second recreational accessory.

13. The equipment carrier of claim 12 wherein said first recreational accessory is a pouch.

14. The equipment carrier of claim 13 wherein said first recreational accessory is a beverage holder.

15. The equipment carrier of claim 14 wherein said second recreational accessory is a pouch.

16. The equipment carrier of claim 13 wherein said second recreational accessory is a beverage holder.

* * * * *